US010287928B2

(12) United States Patent
Ikebe et al.

(10) Patent No.: US 10,287,928 B2
(45) Date of Patent: May 14, 2019

(54) VALVE OPERATING APPARATUS FOR INTERNAL COMBUSTION ENGINE

(71) Applicant: HONDA MOTOR CO., LTD., Tokyo (JP)

(72) Inventors: Yoshiyuki Ikebe, Wako (JP); Hiroshi Yokota, Wako (JP); Satoru Nojima, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 86 days.

(21) Appl. No.: 15/446,692

(22) Filed: Mar. 1, 2017

(65) Prior Publication Data

US 2017/0276028 A1 Sep. 28, 2017

(30) Foreign Application Priority Data

Mar. 28, 2016 (JP) ..... 2016-063041

(51) Int. Cl.
*F01L 1/18* (2006.01)
*F01L 1/047* (2006.01)
(Continued)

(52) U.S. Cl.
CPC ..... *F01L 1/18* (2013.01); *F01L 1/047* (2013.01); *F01L 1/14* (2013.01); *F01L 1/143* (2013.01); *F01L 1/46* (2013.01); *F02B 75/005* (2013.01)

(58) Field of Classification Search
CPC ... F01L 1/047; F01L 1/14; F01L 1/143; F01L 1/18; F01L 1/46; F01L 1/053;
(Continued)

(56) References Cited

U.S. PATENT DOCUMENTS 4,617,881 A * 10/1986 Aoi ..... F01L 1/185 123/90.22
4,638,774 A * 1/1987 Aoi ..... F01L 1/185 123/90.22
(Continued)

FOREIGN PATENT DOCUMENTS

JP 61-3910 U 1/1986
JP 2009-8092 A 1/2009

OTHER PUBLICATIONS

Extended European Search Report issued in European Application No. 17157120.1 dated Aug. 16, 2017.
(Continued)

*Primary Examiner* — Mark A Laurenzi
*Assistant Examiner* — Wesley G Harris
(74) *Attorney, Agent, or Firm* — Birch, Stewart, Kolasch & Birch, LLP

(57) ABSTRACT

A valve operating apparatus for use in an internal combustion engine includes an intake cam 38, an intake rocker arm 33 rotatable about a rotational shaft 35 and driven by the intake cam 38, and an intake valve 40 pushed by a pusher 70 of the intake rocker arm 33, the internal combustion engine has a cylinder assembly 12L lying horizontally, and the intake rocker arm 33 has a weight 67 adjusting the center of gravity of the rocker arm 33 to position the pusher 70 above the rotational shaft 35 while the intake cam 38 is held out of abutting contact with the intake rocker arm 33.

6 Claims, 6 Drawing Sheets

(51) Int. Cl.
*F02B 75/00* (2006.01)
*F01L 1/14* (2006.01)
*F01L 1/46* (2006.01)

(58) Field of Classification Search
CPC ... F01L 1/185; F02B 75/005; F02B 2075/027; F02B 2075/1808; F02B 2275/20
See application file for complete search history.

(56) References Cited

U.S. PATENT DOCUMENTS

| | | | | |
|---|---|---|---|---|
| 4,911,120 | A | 3/1990 | Sumi | |
| 5,060,605 | A * | 10/1991 | Yamazaki | F01L 1/053 123/90.23 |
| 2003/0145820 | A1* | 8/2003 | Yoshida | F01L 13/085 123/182.1 |
| 2008/0264369 | A1* | 10/2008 | Yamamoto | F01L 1/185 123/90.39 |
| 2009/0320792 | A1* | 12/2009 | Kashima | F01L 1/053 123/347 |
| 2010/0077978 | A1* | 4/2010 | Nakashima | F01L 1/02 123/90.16 |

OTHER PUBLICATIONS

Japanese Office Action, dated Feb. 6, 2018, for Japanese Application No. 2016-063041, along with an English machine translation.
Canadian Office Action, dated May 14, 2018, for Canadian Application No. 2,959,345.

* cited by examiner

VALVE OPERATING APPARATUS FOR INTERNAL COMBUSTION ENGINE

INCORPORATION BY REFERENCE

The present application claims priority under 35 U.S.C. § 119 to Japanese Patent Application No. 2016-063041 filed on Mar. 28, 2016. The content of the application is incorporated herein by reference in its entirety.

TECHNICAL FIELD

The present invention relates to a valve operating apparatus for use in an internal combustion engine.

BACKGROUND ART

Heretofore, there has been known a valve operating apparatus for use in an internal combustion engine having a rocker arm, the valve operating apparatus including an adjuster for urging the rocker arm to reduce the gap between the rocker arm and a valve (see, for example, Patent Document 1).

PRIOR ART DOCUMENT

Patent Document

[Patent Document 1]
Japanese Utility Model Laid-Open No. 1986-3910

SUMMARY OF THE INVENTION

Problem to be Solved by the Invention

Since the gap between the rocker arm and the valve can be reduced by the adjuster, the conventional valve operating apparatus is capable of reducing noise produced when the rocker arm and the valve collide with each other. However, it is desirable to be able to reduce the gap between the rocker arm and the valve with a simpler structure.

The present invention has been made in view of the above problem. It is an object of the present invention to provide a valve operating apparatus for use in an internal combustion engine, wherein the gap between a rocker arm and a valve can be reduced with a simple structure.

Means for Solving the Problem

In order to achieve the above object, there is provided in accordance with an aspect of the present invention a valve operating apparatus for use in an internal combustion engine, including a cam (38), a rocker arm (33) rotatable about a rotational shaft (35) and driven by the cam (38), and a valve (40) configured to be pushed by a pusher (70) of the rocker arm (33), wherein the internal combustion engine has a cylinder (12L, 212) lying horizontally, and the rocker arm (33) has a weight (67) adjusting the center of gravity of the rocker arm (33) to position the pusher (70) above the rotational shaft (35) while the cam (38) is held out of abutting contact with the rocker arm (33).

According to the aspect of the present invention, the valve operating apparatus for use in the internal combustion engine includes the cam, the rocker arm rotatable about the rotational shaft and driven by the cam, and the valve configured to be pushed by the pusher of the rocker arm, wherein the internal combustion engine has the cylinder lying horizontally, and the rocker arm has the weight for adjusting the center of gravity of the rocker arm to position the pusher above the rotational shaft while the cam is held out of abutting contact with the rocker arm. Due to the center of gravity of the rocker arm which is displaced by the weight, the rocker arm is placed of its own accord in an angular position where the pusher is spaced from the cam and disposed above the rotational shaft. Consequently, the gap between the rocker arm and the valve can be reduced with a simple structure, and any noise produced upon collision between the rocker arm and the valve can be minimized. Even if the cam is removed upon maintenance or the like of the valve operating apparatus, the rocker arm can be prevented from falling over away from the valve side, resulting in good maintainability of the valve operating apparatus.

An aspect of the present invention is characterized in that the rocker arm (33) is held in abutment against the valve (40) by the weight (67) while the cam (38) is held out of abutting contact with the rocker arm (33).

According to the aspect of the present invention, the rocker arm is caused to abut against the valve because of the weight while the cam is not in abutment against the rocker arm. Therefore, as the rocker arm can be held in abutment against the valve by the center of gravity of the rocker arm which is displaced by the weight, any gap between the rocker arm and the valve can be minimized as much as possible, reducing noise which is produced when the rocker arm and the valve collide with each other.

An aspect of the present invention is characterized in that the weight (67) is located on the side of the rotational shaft (35) which is closer to the valve (40) side as viewed from the axial direction of the rotational shaft (35) and extends substantially horizontally.

According to the aspect of the present invention, the weight is located on the side of the rotational shaft which is closer to the valve side as viewed from the axial direction of the rotational shaft and extends substantially horizontally. This layout can increase a moment with which the weight tends to turn the rocker arm toward the valve side, thereby effectively reducing the gap between the rocker arm and the valve. As the moment is made sufficient even if the weight is relatively light, the rocker arm can be lightweight.

An aspect of the present invention is characterized in that the weight (67) is positioned across the rotational shaft (35) from the cam (38) as viewed from the axial direction of the rotational shaft (35) and extends substantially horizontally.

According to the aspect of the present invention, the weight is positioned across the rotational shaft from the cam as viewed from the axial direction of the rotational shaft and extends substantially horizontally. This layout can increase a moment with which the weight tends to turn the rocker arm around the rotational shaft away from the cam, thereby effectively reducing the gap between the rocker arm and the valve. As the moment is made sufficient even if the weight is relatively light, the rocker arm can be lightweight.

An aspect of the present invention is characterized in that the width (W1) of the weight (67) is smaller than the width (W2) of a bearing (65) by which the rocker arm (33) is supported on the rotational shaft (35).

According to the aspect of the present invention, the width of the weight is smaller than the width of the bearing by which the rocker arm is supported on the rotational shaft. Accordingly, the weight can be extended to a position spaced from the rotational shaft for thereby effectively increasing a moment with which the weight turns the rocker arm toward the valve. As the weight is kept within the width of the bearing, the weight can be prevented from adversely affecting the layout of nearby components.

According to the aspect of the present invention, there is also provided a valve operating apparatus for use in an internal combustion engine, including a cam (38), a rocker arm (33) rotatable about a rotational shaft (35) and driven by the cam (38), and a valve (40) configured to be pushed by a pusher (70) of the rocker arm (33), wherein the internal combustion engine has a cylinder (12L, 212) lying horizontally, and the rocker arm (33) has a weight (67) for turning the rocker arm (33) to move the pusher (70) in a direction away from the cam (38).

According to the aspect of the present invention, the rocker arm has the weight for turning the rocker arm in a direction to move the pusher away from the cam. By this, since the weight is able to turn the rocker arm in a direction to move the pusher toward the valve, the gap between the rocker arm and the valve can be reduced with a simple structure, and any noise produced upon collision between the rocker arm and the valve can be minimized. In addition, even if the cam is removed upon maintenance or the like of the valve operating apparatus, the rocker arm can be prevented from falling over away from the valve side, resulting in good maintainability of the valve operating apparatus.

Effects of the Invention

In the valve operating apparatus for use in the internal combustion engine according to the aspect of the present invention, the gap between the rocker arm and the valve can be reduced with a simple structure with the weight, and any noise produced upon collision between the rocker arm and the valve can be minimized. Furthermore, the valve operating apparatus has good maintainability.

In addition, since the rocker arm is kept in abutment against the valve, noise produced upon collision between the rocker arm and the valve can be reduced.

Further, as the moment is made sufficient even if the weight is relatively light, the rocker arm can be lightweight.

Furthermore, though the weight may be compact, the moment for rotation produced thereby can be increased.

MODES FOR CARRYING OUT THE INVENTION

Figure 1:
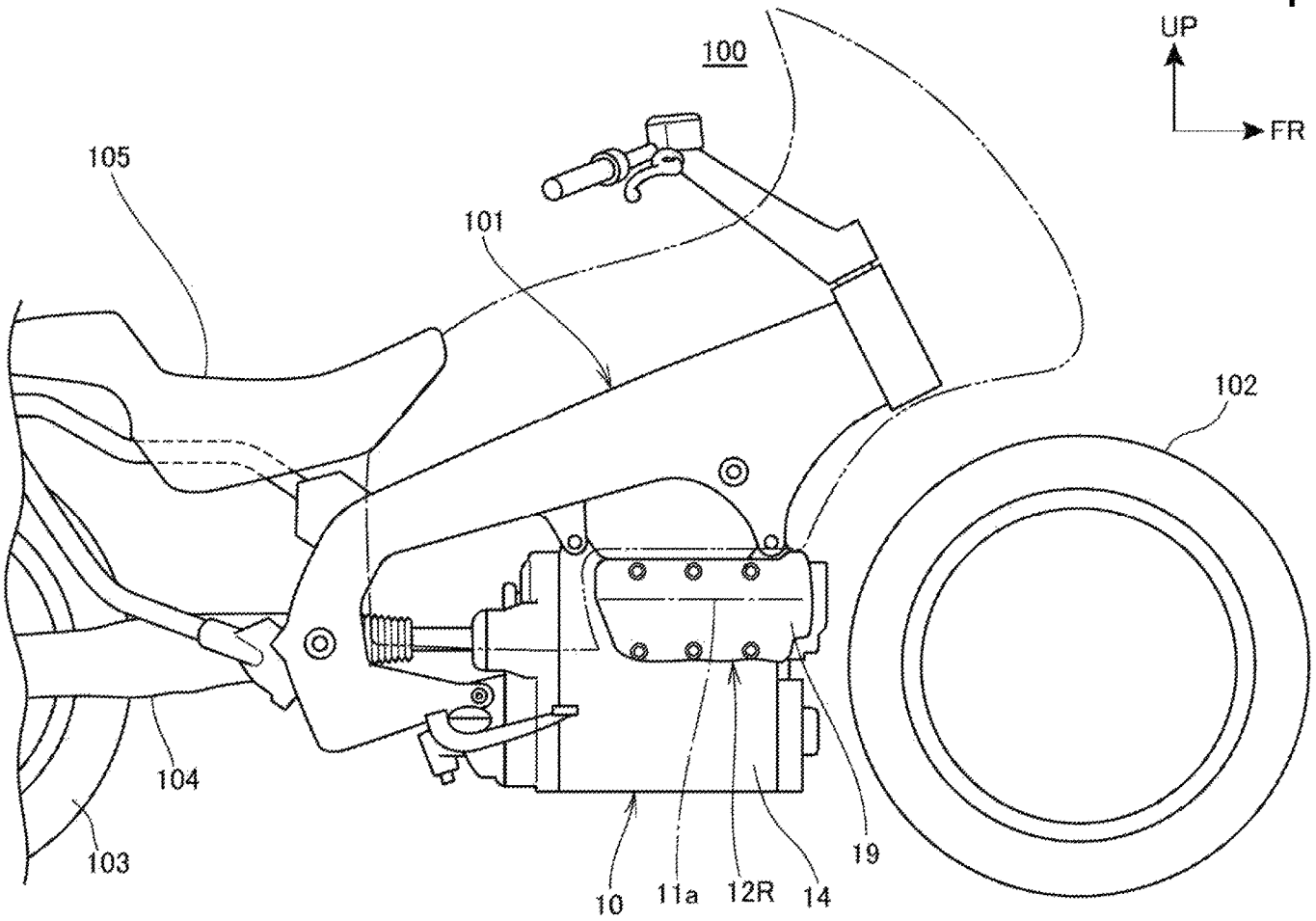
FIG. 1 is a right-hand side elevational view of a motorcycle according to a first embodiment of the present invention.

Embodiments of the present invention will be described below with reference to the accompanying drawings. Directions such as forward, rearward, leftward, rightward, upward, and downward directions referred to in the description below shall be in accord with those on a vehicle on which an internal combustion engine is mounted unless specified otherwise. In the drawings, the reference symbol FR represent a forward direction of the vehicle, the reference symbol UP an upward direction of the vehicle, and the reference symbol LH a leftward direction of the vehicle.

[First Embodiment]

FIG. 1 is a right-hand side elevational view of a motorcycle according to a first embodiment of the present invention.

The motorcycle 100 is a vehicle including a vehicle frame 101, an internal combustion engine 10 supported as a power unit on the vehicle frame 101, a front wheel 102 steerably supported on a front fork, not shown, that is steerably supported on the front end of the vehicle frame 101, and a rear wheel 103 supported on a swing arm 104 that is mounted on a side of a rear portion of the vehicle frame 101. The motorcycle 100 is a saddle-type vehicle having a rider's seat 105 where the rider is to be seated astride, disposed above a rear portion of the vehicle frame 101.

The internal combustion engine 10 is disposed between the front wheel 102 and the rear wheel 103, and supported to be suspended from the vehicle frame 101. The internal combustion engine 10 has a crankshaft 11 (see FIG. 2) whose axis 11*a* extends substantially horizontally along the longitudinal direction of the vehicle.

According to the first embodiment, an arrangement wherein the internal combustion engine 10 is mounted on the motorcycle 100 as a vehicle will be described by way of example. The vehicle on which the internal combustion engine 10 is mounted may be a three-wheeled vehicle having two front or rear wheels or a vehicle provided with four or more wheels.

Figure 2:
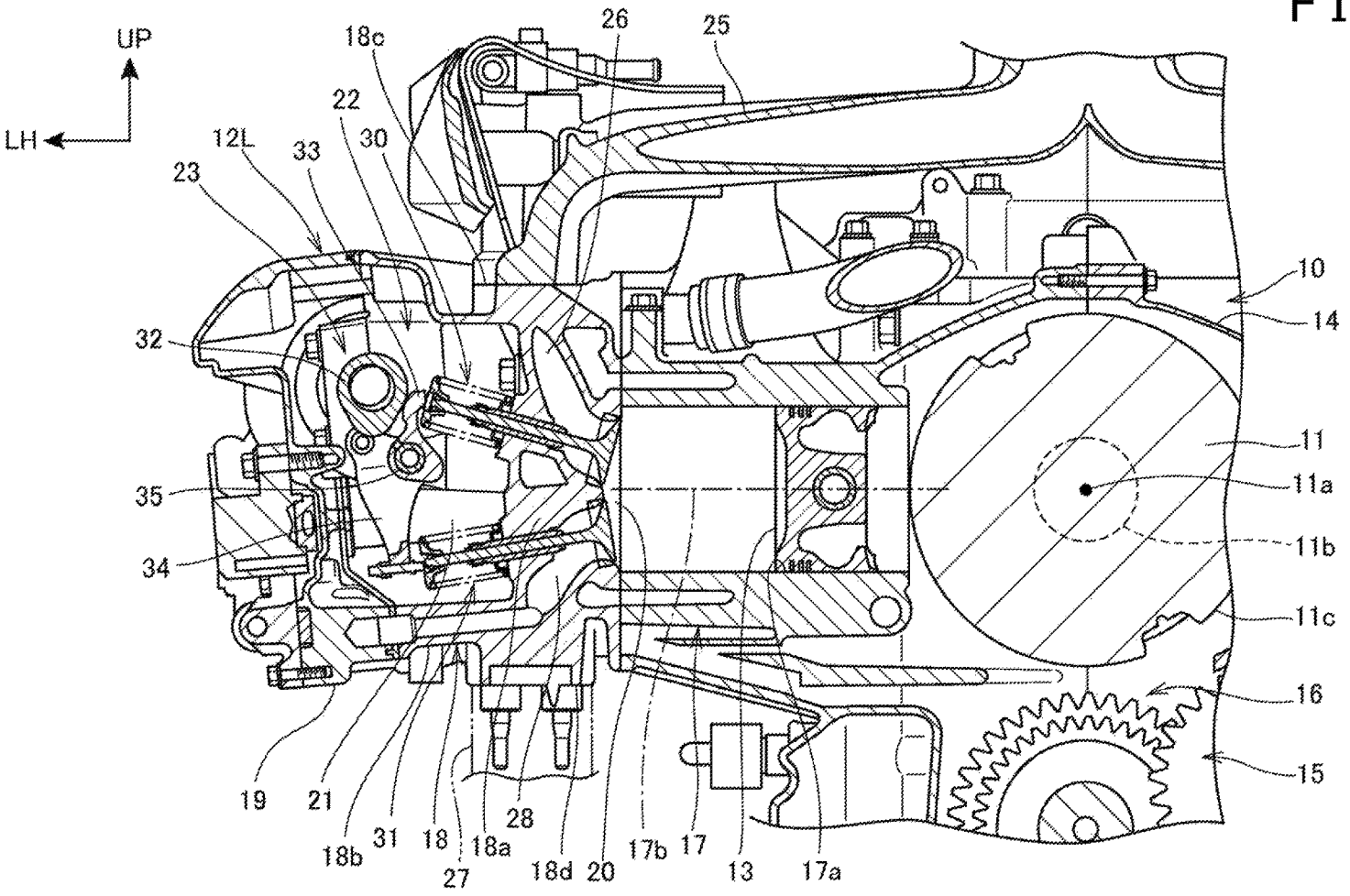
FIG. 2 is a cross-sectional view of an internal combustion engine.

FIG. 2 is a cross-sectional view of the internal combustion engine 10.

The internal combustion engine 10 includes a horizontally opposed cylinder engine including cylinder assemblies 12L and 12R lying horizontally on one side and the other, respectively, with the single crankshaft 11 interposed therebetween, and a pair of pistons 13 reciprocally movable in facing relation to each other. According to the first embodiment, the crankshaft 11 extends straight substantially horizontally along the longitudinal direction of the motorcycle 100, and the cylinder assemblies 12L and 12R extend horizontally to the left (one side) and the right (the other side), respectively, of the motorcycle 100 with the crankshaft 11 at the center.

Specifically, FIG. 2 is a cross-sectional view of the internal combustion engine 10, taken along a plane perpendicular to the axis 11*a* of the crankshaft 11. FIG. 2 illustrates the left cylinder assembly 12L (cylinder) and a central portion of the internal combustion engine 10 along the transverse direction of the vehicle. Since the left cylinder assembly 12L and the right cylinder assembly 12R have a structure of substantially bilateral symmetry, structural details of the left cylinder assembly 12L will be described in the first embodiment.

The internal combustion engine 10 includes a crankcase 14 positioned centrally along the transverse direction of the vehicle and supporting the crankshaft 11, and the cylinder assemblies 12L and 12R extending horizontally from the crankcase 14 along the transverse direction of the vehicle.

The crankshaft 11 extends along the longitudinal direction of the vehicle at the center along the transverse direction of the vehicle. The crankshaft 11 has a shaft body 11*b* supported by a bearing of the crankcase 14 and a crank web 11*c*.

The crankcase 14 includes a transmission chamber 15 in a lower portion thereof that is positioned below the crankshaft 11. The transmission chamber 15 houses therein a transmission 16 for outputting the output power of the crankshaft 11 at a speed reduction ratio to the rear wheel 103 side which serves as a drive wheel.

The cylinder assembly 12L includes, successively from the crankcase 14 side, a cylinder block 17, a cylinder head 18 coupled to the cylinder block 17, and a head cover 19 coupled to the cylinder head 18. The cylinder block 17 is integrally formed with the crankcase 14.

The cylinder block 17 has a cylinder bore 17*a* defined therein in which the piston 13 is disposed. The cylinder bore 17*a* has a cylinder axis 17*b* extending horizontally along the transverse direction of the vehicle perpendicularly to the crankshaft 11. The piston 13 is connected to a crankpin of the crankshaft 11 by a connecting rod, not shown.

The cylinder head 18 has a bottom wall 18*a* coupled to an end face of the cylinder block 17 and closing the cylinder bore 17*a*, and a peripheral wall 18*b* extending outwardly along the transverse direction of the vehicle from the entire peripheral edge of the bottom wall 18*a*. The bottom wall 18*a* serves as the bottom of the cylinder head 18 in the axial direction of the cylinder axis 17*b*. The bottom wall 18*a* and the cylinder bore 17*a* define a combustion chamber 20 therebetween. An ignition plug, not shown, housed in a tubular plug insertion cavity 21 has electrodes disposed in the combustion chamber 20.

The cylinder head 18 has a laterally open valve operating chamber 22 defined inwardly of the peripheral wall 18*b*. The valve operating chamber 22 accommodates therein a valve operating apparatus 23 for controlling the intake and exhaust actions of the internal combustion engine 10. The valve operating chamber 22 is sealed by the head cover 19 attached to an end face of the peripheral wall 18*b*.

The cylinder head 18 includes an intake pipe connector 18*c* to which an intake pipe 25 is connected, on an upper surface thereof in the vertical direction of the motorcycle 100. An air cleaner, not shown, is disposed upstream of and connected to the intake pipe 25. The intake pipe connector 18*c* is held in fluid communication with the combustion chamber 20 through an intake port 26 defined in the bottom wall 18*a*.

The cylinder head 18 also includes an exhaust pipe connector 18*d* to which an exhaust pipe 27 is connected, on a lower surface thereof in the vertical direction of the motorcycle 100. The exhaust pipe connector 18*d* is held in fluid communication with the combustion chamber 20 through an exhaust port 28 defined in the bottom wall 18*a*.

Figure 3:
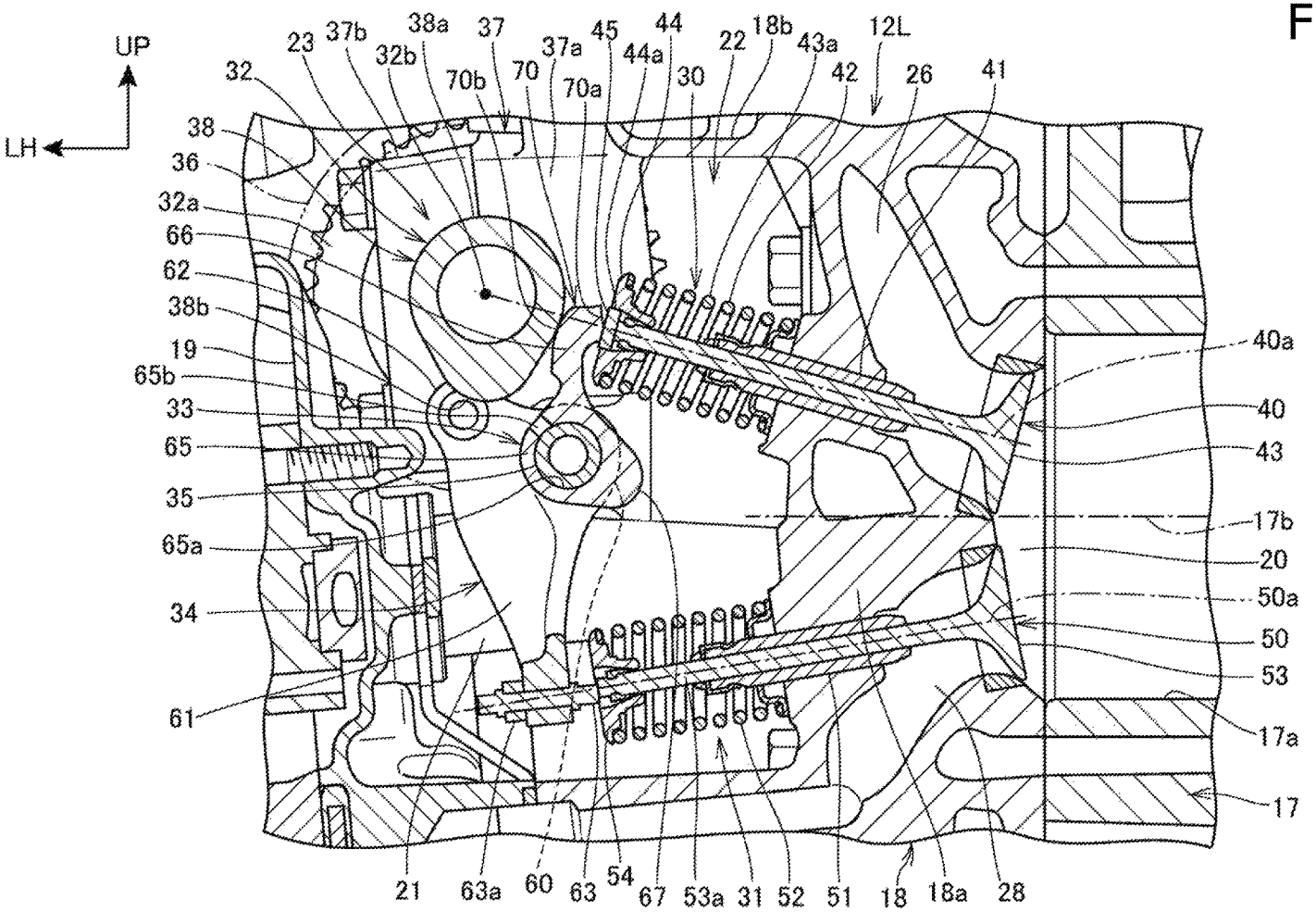
FIG. 3 is an enlarged cross-sectional view of a valve operating apparatus and its periphery shown in FIG. 2.

FIG. 3 is an enlarged cross-sectional view of the valve operating apparatus 23 and its periphery shown in FIG. 2.

The valve operating apparatus 23 includes an intake valve unit 30 for opening and closing the intake port 26, an exhaust valve unit 31 for opening and closing the exhaust port 28, a camshaft 32 driven by the crankshaft 11 (see FIG. 2), an intake rocker arm 33 (rocker arm) for driving the intake valve unit 30, an exhaust rocker arm 34 for driving the exhaust valve unit 31, and a rotational shaft 35 by which the intake rocker arm 33 and the exhaust rocker arm 34 are angularly movably supported in the cylinder head 18.

The camshaft 32 is driven and rotated about its own axis by a cam chain 36 trained around a sprocket 32*a* mounted on an axial end of the camshaft 32 and the crankshaft 11.

The intake valve unit 30 includes an intake valve 40 (valve), a valve guide 41 for guiding the intake valve 40, and a valve spring 42 for urging the intake valve 40 to move in a valve closing direction.

The intake valve 40 includes an intake valve body 43, a disk-shaped valve lifter 44 provided on an axial end of a valve stem 43*a* of the intake valve body 43, and a plate-like shim 45 disposed on an end face of the valve stem 43*a*. The valve spring 42 is disposed in a compressed state between the bottom wall 18*a* and the valve lifter 44. The valve lifter 44 has a shim storage hole 44*a* defined centrally therein, and the shim 45 is held in the shim storage hole 44*a* and abuts against the end face of the valve stem 43*a*.

The exhaust valve unit 31 includes an exhaust valve 50, a valve guide 51 for guiding the exhaust valve 50, and a valve spring 52 for urging the exhaust valve 50 to move in a valve closing direction.

The exhaust valve 50 includes an exhaust valve body 53 and a disk-shaped valve lifter 54 provided on an axial end of a valve stem 53*a* of the exhaust valve body 53. The valve spring 52 is provided in a compressed state between the bottom wall 18*a* and the valve lifter 54.

The intake valve unit 30 and the exhaust valve unit 31 are erected from the bottom wall 18*a* nearly along the cylinder axis 17*b* outwardly along the transverse direction of the vehicle. The intake valve unit 30 is disposed above the cylinder axis 17*b*, and the exhaust valve unit 31 is disposed below the cylinder axis 17*b*. Specifically, the intake valve 40 and the exhaust valve 50 are disposed in a V-shaped layout such that the intake valve 40 and the exhaust valve 50 have respective axes 40*a* and 50*a* angularly spaced from each other by a predetermined angle.

The intake valve 40 and the exhaust valve 50 are juxtaposed in the gravitational direction, i.e., a vertically downward direction. The intake valve 40 is disposed above the exhaust valve 50 with respect to the gravitational direction.

The camshaft 32 includes a shaft extending parallel to the crankshaft 11 along the longitudinal direction of the motorcycle 100 and has an axis 32*b* lying parallel to the crankshaft 11. The camshaft 32 is disposed in a position spaced from an axial end of the intake valve 40 outwardly along the transverse direction of the vehicle. Specifically, the camshaft 32 is disposed in such a position that the axis 32*b* thereof is substantially superposed on an extension of the axis 40*a* of the intake valve 40.

The camshaft 32 is rotatably supported by a plurality of camshaft holders 37 provided on the bottom wall 18*a* of the cylinder head 18. The camshaft holders 37 are spaced at intervals along the axis 32*b*. Each of the camshaft holders 37 includes a head holder 37*a* integrally formed with the bottom wall 18*a* and a cap 37*b* fastened to the head holder 37*a*.

The camshaft 32 is provided with an intake cam 38 (cam) for causing the intake rocker arm 33 to push the intake valve 40 and an exhaust cam, not shown, for causing the exhaust rocker arm 34 to push the exhaust valve 50. The intake cam 38 and the exhaust cam are spaced from each other along the axis 32*b*.

The intake cam 38 includes a completely round base-circle portion 38*a* and a cam lobe 38*b* projecting radially outwardly from the completely round base-circle portion 38*a*.

The rotational shaft 35 that supports the intake rocker arm 33 and the exhaust rocker arm 34 thereon is a shaft extending parallel to the camshaft 32 along the longitudinal direction of the motorcycle 100. The rotational shaft 35 is supported by a plurality of rotational shaft supports, not shown, erected from the bottom wall 18*a*. The rotational shaft supports are spaced at intervals along the rotational shaft 35.

The rotational shaft 35 is positioned vertically between the intake valve 40 and the exhaust valve 50, and positioned above the cylinder axis 17*b*. With respect to the axial direction of the cylinder axis 17*b*, i.e., the transverse direction of the vehicle, the rotational shaft 35 is positioned between the axial end of the intake valve 40 and the camshaft 32.

The exhaust rocker arm 34 includes a tubular support hole portion 60 angularly movably supported on the rotational shaft 35, an arm 61 extending from the support hole portion 60 toward the exhaust valve unit 31 side, and an exhaust cam abutment 62 extending from the support hole portion 60 toward the exhaust cam side of the camshaft 32.

The exhaust cam abutment 62 is held in rolling abutment against the exhaust cam through a roller, for example. The arm 61 has on a distal end thereof a pin-shaped abutment 63 held in abutment against an axial end of the exhaust valve 50. The abutment 63 is axially adjustable in position, and has its position secured by a nut 63*a* threaded over the abutment 63. By adjusting the secured position of the abutment 63 with the nut 63*a*, it is possible to adjust an exhaust valve clearance provided as the gap between the abutment 63 and the axial end of the exhaust valve 50.

Figure 4:
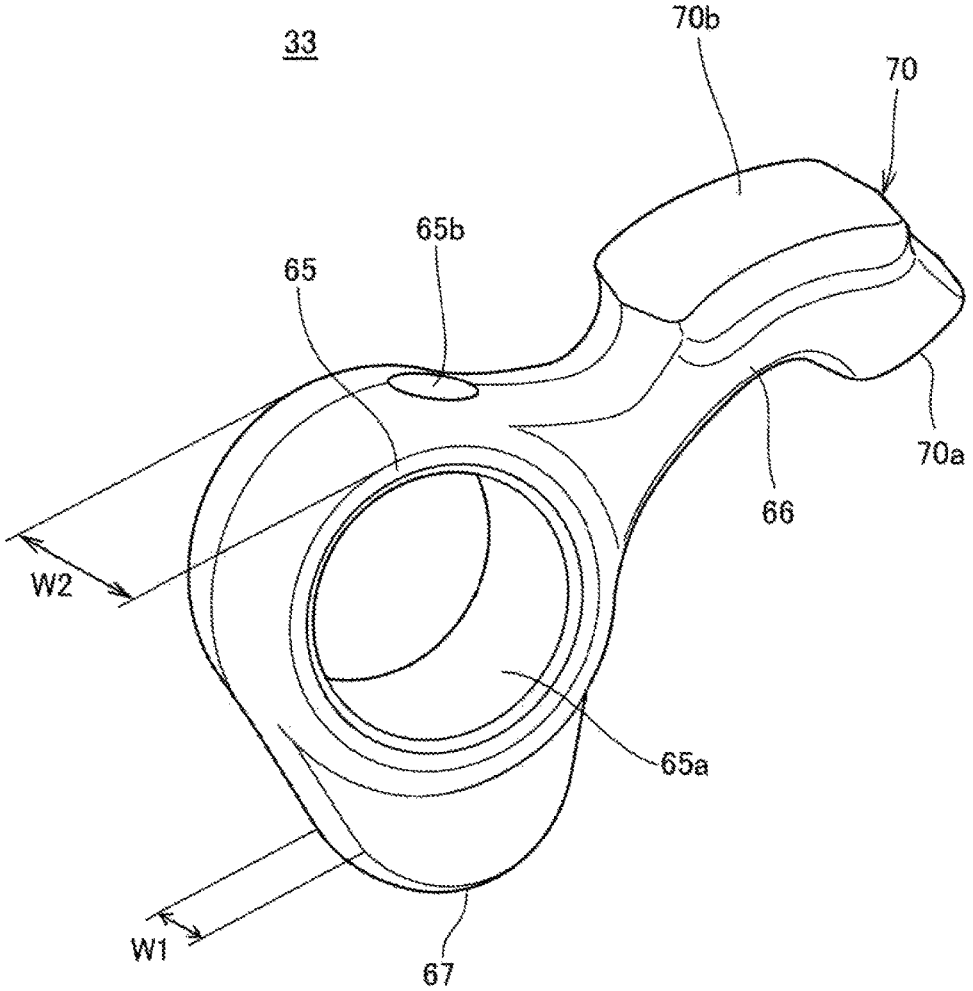
FIG. 4 is a perspective view of an intake rocker arm.

FIG. 4 is a perspective view of the intake rocker arm 33.

As shown in FIGS. 3 and 4, the intake rocker arm 33 includes a hollow cylindrical bearing 65 angularly movably supported on the rotational shaft 35, an arm 66 extending from the bearing 65 into a space between the intake cam 38 and the axial end of the intake valve 40, and a weight 67 extending radially outwardly from an outer circumferential portion of the bearing 65.

The intake rocker arm 33 is disposed above the exhaust rocker arm 34 with respect to the gravitational direction.

The bearing 65 has a support hole 65*a* defined therein through which the rotational shaft 35 is inserted. The intake rocker arm 33 is angularly movable around the rotational shaft 35 through the support hole 65*a*. The intake rocker arm 33 and the exhaust rocker arm 34 are supported on the rotational shaft 35 in coaxial relation to each other.

The bearing 65 has an oil hole 65*b* defined therein which extends from a surface thereof facing the intake cam 38 radially through the bearing 65 to the support hole 65*a*. Part of oil supplied to the valve operating apparatus 23 is supplied through the oil hole 65*b* to the support hole 65*a*.

The arm 66 has on its distal end a pusher 70 held in abutment against the axial end of the intake valve 40.

The pusher 70 has a valve abutment surface 70*a* facing inwardly along the transverse direction of the vehicle and held in abutment against the axial end of the intake valve 40. Specifically, the abutment surface 70*a* abuts against the shim 45 of the intake valve 40, and pushes the intake valve body 43 through the shim 45. The abutment surface 70*a* is of an arcuate shape for smooth abutment against the shim 45.

The pusher 70 has a cam sliding surface 70*b* facing outwardly along the transverse direction of the vehicle and held in abutment against the intake cam 38 of the camshaft 32. The cam sliding surface 70*b* is of an arcuate shape for smooth abutment against the intake cam 38.

When the intake cam 38 is in such a rotary phase that the base-circle portion 38*a* abuts against the cam sliding surface 70*b* of the intake rocker arm 33 as shown in FIG. 3, the intake port 26 is closed by the intake valve 40. When the intake cam 38 is in such a rotary phase that the cam lobe 38*b* abuts against the cam sliding surface 70*b* of the intake rocker arm 33, the intake rocker arm 33 is pushed by the cam lobe 38*b* to turn about the rotational shaft 35, causing the pusher 70 to push the intake valve 40 against the bias of the valve spring 42, thereby opening the intake port 26.

When the exhaust rocker arm 34 is driven by a cam lobe of the exhaust cam, the exhaust valve 50 is pushed against the bias of the valve spring 52, thereby opening the exhaust port 28.

Figure 5:
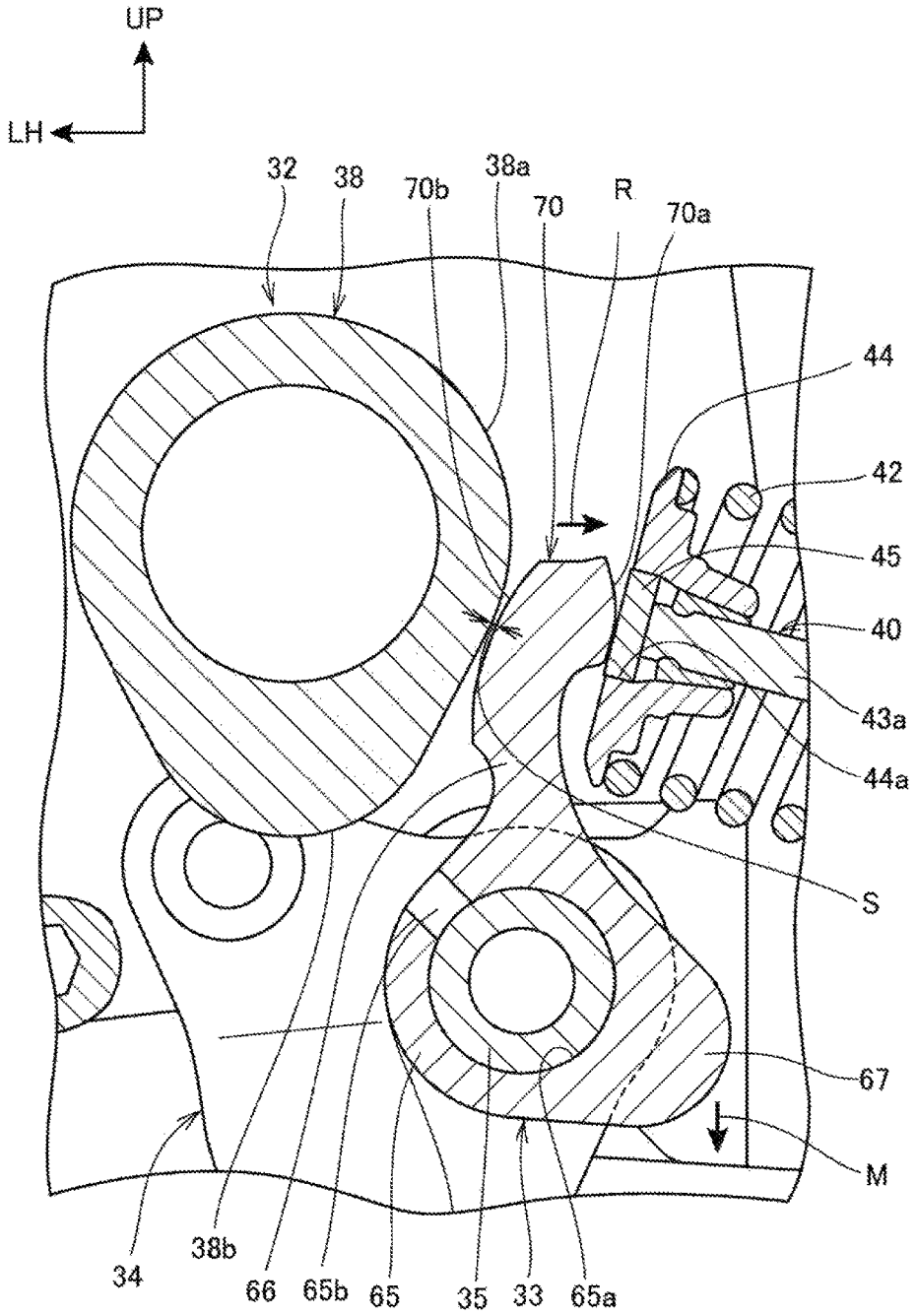
FIG. 5 is an enlarged cross-sectional view of the intake rocker arm and its periphery shown in FIG. 2.

FIG. 5 is an enlarged cross-sectional view of the intake rocker arm 33 and its periphery shown in FIG. 2.

As shown in FIG. 5, the arm 66 of the intake rocker arm 33 extends substantially vertically upwardly from the rotational shaft 35 side, and the pusher 70 is sandwiched between the intake cam 38 and the shim 45 at the axial end of the intake valve 40.

Between the shim 45 and the valve abutment surface 70*a* of the intake rocker arm 33, there is a gap of a predetermined size, i.e., an intake valve clearance, for dealing with a thermal expansion of the intake valve body 43. When the intake rocker arm 33 is not pushing the intake valve 40, therefore, the intake rocker arm 33 is slightly angularly movable between the base-circle portion 38*a* and the shim 45 by a distance commensurate with the intake valve clearance. The intake valve clearance tends to be larger when the internal combustion engine 10 is at lower temperatures, and smaller due to a thermal expansion of the intake valve body 43 or the like when the internal combustion engine 10 is at higher temperatures.

The intake valve clearance can be adjusted by replacing the shim 45 with a shim having a different thickness as necessary.

As shown in FIGS. 3 through 5, the weight 67 of the intake rocker arm 33 is located on one side of the rotational shaft 35 which is closer to the intake valve 40 along the axial direction of the cylinder axis 17*b*, i.e., the transverse direction of the vehicle. In other words, the weight 67 is positioned across the rotational shaft 35 from the intake cam 38, or more specifically, extends from the outer circumferential surface of the bearing 65 substantially horizontally toward the bottom wall 18*a* side. The weight 67 has an arcuately shaped tip end.

Since the portion of the intake rocker arm 33 where the weight 67 is provided is relatively heavy, the intake rocker arm 33 is caused to turn about the rotational shaft 35 by the weight 67 which tends to fall by gravity. In other words, the intake rocker arm 33 is turned by a moment M for rotation that is caused by its center of gravity displaced by the weight 67.

According to the first embodiment, as the weight 67 is located on the side of the intake rocker arm 33 that is closer to the intake valve 40 side, the intake rocker arm 33 is caused by the weight 67 to turn in the direction indicated by the arrow R to bring the pusher 70 toward the shim 45. Stated otherwise, the intake rocker arm 33 is caused by the weight 67 to turn to move the pusher 70 in a direction away from the intake cam 38. The direction indicated by the arrow R refers to a direction in which the intake rocker arm 33 is turned to push the intake valve 40 to open the intake port 26.

The intake rocker arm 33 which is caused by the weight 67 to turn in the direction indicated by the arrow R keeps the pusher 70 positioned above the rotational shaft 35.

Specifically, the intake rocker arm 33 which is caused by the weight 67 to turn in the direction indicated by the arrow R keeps the valve abutment surface 70*a* of the pusher 70 in abutment against the shim 45 of the intake valve 40. In this state, there exists a gap S commensurate with the intake valve clearance between the base-circle portion 38*a* of the intake cam 38 and the cam sliding surface 70*b* of the intake rocker arm 33, and the intake rocker arm 33 is not in abutment against the intake cam 38.

Inasmuch as the pusher 70 of the intake rocker arm 33 is held in abutment against the shim 45 by the center of gravity of the intake rocker arm 33 which is displaced by the weight 67, the pusher 70 is held in abutment against the shim 45 with a simple structure. When the intake rocker arm 33 is driven by the intake cam 38 to cause the valve abutment surface 70*a* of the pusher 70 to push the shim 45, therefore, the valve abutment surface 70*a* can be prevented from colliding with the shim 45, thereby avoiding the production of noise due to such collision.

Since intake valve 40 is driven at a high speed, the pusher 70 may not necessarily be held in abutment against the shim 45 at all times by the weight 67 tending to turn the intake rocker arm 33. However, the weight 67 is effective to bring the pusher 70 closer to the shim 45. Accordingly, the valve abutment surface 70*a* is less likely to collide with the shim 45, thereby reducing noise produced by such collision.

When the camshaft 32 is removed from the cylinder head 18 upon maintenance of the valve operating apparatus 23, the intake rocker arm 33 is caused by the weight 67 to remain in abutment against the shim 45. Consequently, while the valve operating apparatus 23 is being serviced for maintenance or the like, the intake rocker arm 33 can be prevented from falling away from the intake valve 40 and hence from interfering with maintenance activities.

The weight 67 has a width W1 along the axial direction of the rotational shaft 35, which width W1 is smaller than the width W2 of the bearing 65 along the axial direction of the rotational shaft 35 and hence is kept within the width W2 of the bearing 65.

The weight 67 may be extended radially outwardly from the bearing 65 to increase the moment M for rotation of the intake rocker arm 33. Therefore, the weight 67 is able to produce a sufficiently large moment M even though the weight 67 is relatively light. The weight 67 is unlikely to present an obstacle to the layout of other components positioned nearby.

According to the first embodiment of the present invention, as described above, the valve operating apparatus 23 of the internal combustion engine 10 includes the intake cam 38, the intake rocker arm 33 rotatable about the rotational shaft 35 and driven by the intake cam 38, and the intake valve 40 configured to be pushed by the pusher 70 of the intake rocker arm 33, wherein the internal combustion engine 10 has the cylinder assembly 12L lying horizontally, and the intake rocker arm 33 has the weight 67 for adjusting the center of gravity of the intake rocker arm 33 to position the pusher 70 above the rotational shaft 35 while the intake cam 38 is held out of abutting contact with the intake rocker arm 33. Due to the center of gravity of the intake rocker arm 33 which is displaced by the weight 67, the intake rocker arm 33 is placed of its own accord in an angular position where the pusher 70 is spaced from the intake cam 38 and disposed above the rotational shaft 35. Consequently, the gap between the intake rocker arm 33 and the intake valve 40 can be reduced with a simple structure, and any noise produced upon collision between the intake rocker arm 33 and the intake valve 40 can be minimized. Even if the intake cam 38 is removed upon maintenance or the like of the valve operating apparatus 23, the intake rocker arm 33 can be prevented from falling over away from the intake valve 40 side, resulting in good maintainability of the valve operating apparatus 23.

The intake rocker arm 33 is caused to abut against the intake valve 40 because of the presence of the weight 67 while the intake cam 38 is not in abutment against the intake rocker arm 33. Therefore, as the intake rocker arm 33 is held in abutment against the intake valve 40 by the center of gravity of the intake rocker arm 33 which is displaced by the weight 67, any gap between the intake rocker arm 33 and the intake valve 40 is minimized, reducing noise which is produced when the intake rocker arm 33 and the intake valve 40 collide with each other.

The weight 67 is located on the side of the rotational shaft 35 which is closer to the intake valve 40 side as viewed from the axial direction of the rotational shaft 35 and extends substantially horizontally. This layout can increase the moment M with which the weight 67 tends to turn the intake rocker arm 33 toward the intake valve 40 side, thereby effectively reducing the gap between the intake rocker arm 33 and the intake valve 40. As the moment M can be made sufficient even if the weight 67 is relatively light, the intake rocker arm 33 can be lightweight.

The weight 67 is positioned across the rotational shaft 35 from the intake cam 38 and extends substantially horizontally. This layout can increase the moment M with which the weight 67 tends to turn the intake rocker arm 33 around the rotational shaft 35 away from the intake cam 38, thereby effectively reducing the gap between the intake rocker arm 33 and the intake valve 40. As the moment M can be made sufficient even if the weight 67 is relatively light, the intake rocker arm 33 can be lightweight.

The width W1 of the weight 67 is smaller than the width W2 of the bearing 65 by which the intake rocker arm 33 is angularly movably supported on the rotational shaft 35. Accordingly, the weight 67 can be extended to a position spaced from the rotational shaft 35 for thereby effectively increasing the moment M with which the weight 67 turns the intake rocker arm 33 toward the intake valve 40 side. As the weight 67 is kept within the width W2 of the bearing 65, the weight 67 can be prevented from adversely affecting the layout of nearby components.

The valve operating apparatus 23 of the internal combustion engine 10 includes the intake cam 38, the intake rocker arm 33 rotatable about the rotational shaft 35 and driven by the intake cam 38, and the intake valve 40 configured to be pushed by the pusher 70 of the intake rocker arm 33, wherein the internal combustion engine 10 has the cylinder assembly 12L lying horizontally, and the intake rocker arm 33 has the weight 67 for turning the intake rocker arm 33 in a direction to move the pusher 70 in a direction away from the intake cam 38. Since the weight 67 is able to turn the intake rocker arm 33 in a direction to move the pusher 70 toward the intake valve 40, the gap between the intake rocker arm 33 and the intake valve 40 can be reduced with a simple structure, and any noise produced upon collision between the intake rocker arm 33 and the intake valve 40 can be minimized. Even if the intake cam 38 is removed upon maintenance or the like of the valve operating apparatus 23, the intake rocker arm 33 can be prevented from falling over away from the intake valve 40 side, resulting in good maintainability of the valve operating apparatus 23.

[Second Embodiment]

A second embodiment of the present invention will be described below with reference to FIG. 6. Those parts of the second embodiment which are identical to those of the first embodiment will be denoted by identical reference symbols, and will not be described in detail below.

The second embodiment is different from the first embodiment in that a cylinder assembly 212 of a motorcycle 200 extends horizontally along the longitudinal direction of the motorcycle 200.

Figure 6:
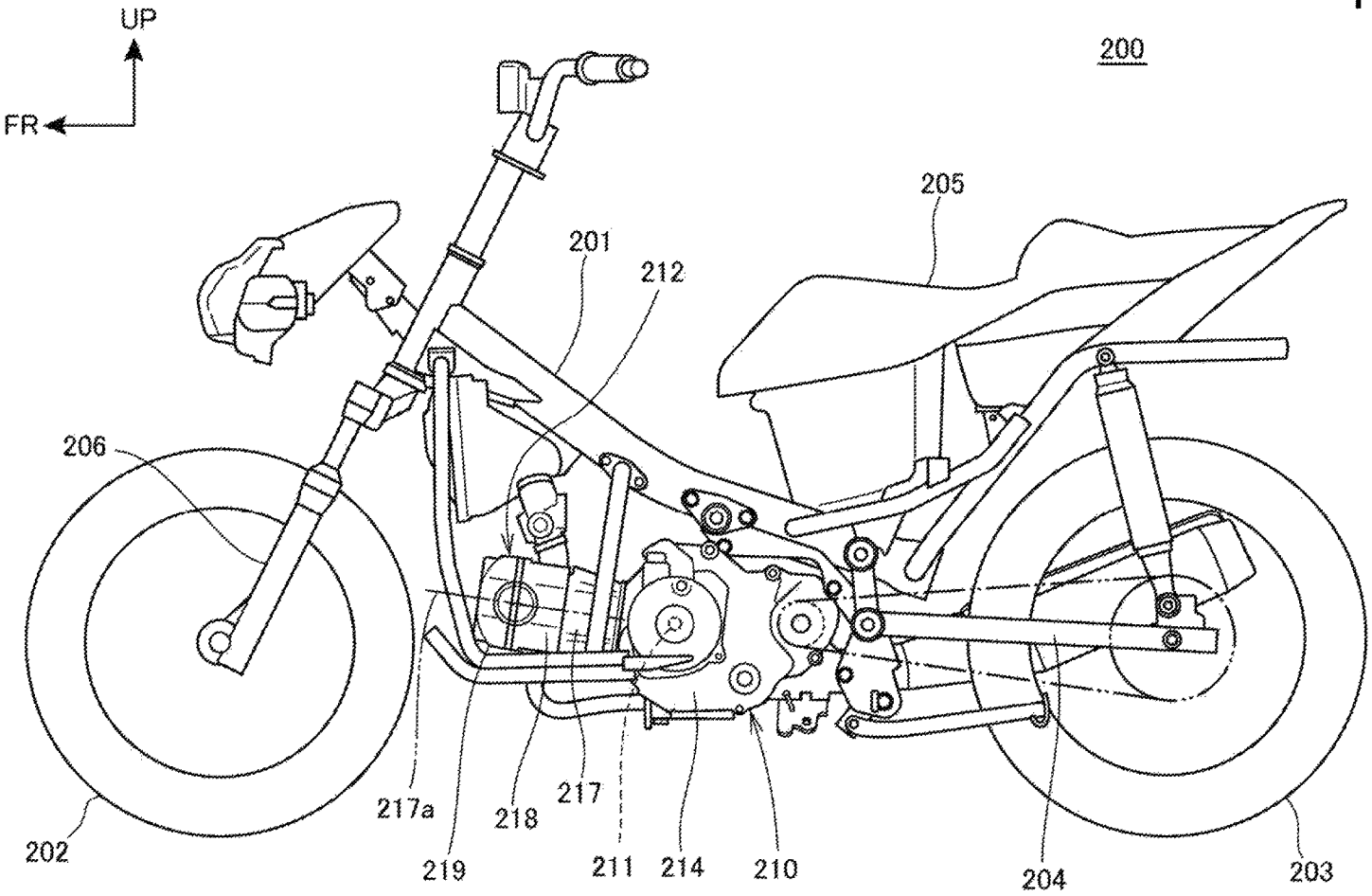
FIG. 6 is a left-hand side elevational view of a motorcycle according to a second embodiment of the present invention.

FIG. 6 is a left-hand side elevational view of the motorcycle 200 according to the second embodiment of the present invention.

The motorcycle 200 is a vehicle including a vehicle frame 201, an internal combustion engine 210 supported as a power unit on the vehicle frame 201, a front wheel 202 steerably supported on a front fork 206 that is steerably supported on the front end of the vehicle frame 201, and a rear wheel 203 supported on a swing arm 204 that is mounted on a rear portion of the vehicle frame 201. The motorcycle 200 is a saddle-type vehicle having a rider's seat 205 where the rider is to be seated astride, disposed above a rear portion of the vehicle frame 201.

The internal combustion engine 210 is disposed between the front wheel 202 and the rear wheel 203, and supported to be suspended from the vehicle frame 201. The internal combustion engine 210 has a crankshaft 211 extending horizontally along the transverse direction of the vehicle.

The internal combustion engine 210 includes a crankcase 214 supporting the crankshaft 211 and a cylinder assembly 212 (cylinder) extending substantially horizontally forwardly from the crankcase 214. In other words, the internal combustion engine 210 is a horizontal cylinder engine wherein the cylinder assembly 212 extends horizontally.

The cylinder assembly 212 includes, successively from the crankcase 214 side, a cylinder block 217, a cylinder head 218 coupled to the cylinder block 217, and a head cover 219 coupled to the cylinder head 218. The cylinder assembly 212 has a cylinder axis 217*a* extending substantially horizontally along the longitudinal direction of the motorcycle 200 perpendicularly to the crankshaft 211. The internal combustion engine 210 includes a single-cylinder engine. However, the principles of the present invention are also applicable to an internal combustion engine having a plurality of cylinders.

The cylinder assembly 212 includes a valve operating apparatus, not shown, wherein a rotational shaft and a cam shaft extend parallel to the crankshaft 211 along the transverse direction of the vehicle. The weight according to the present invention may be applied to the rocker arm of the valve operating apparatus of the internal combustion engine 210 wherein the cylinder assembly 212 extends along the longitudinal direction of the vehicle.

The first and second embodiments described above illustrate aspects of the present invention by way of example only, and the present invention should not be construed as being limited to the above first and second embodiments.

In the first and second embodiments, the configuration in which the cylinder axis 17*b* or 217*a* of the cylinder assembly 12L or 212 extends horizontally has been described by way of example. However, the present invention is not limited to such an arrangement. The cylinder assembly (cylinder) may extend substantially horizontally insofar as the rocker arm extends vertically and the weight on the rocker arm is capable of turning the rocker arm in a direction away from the cam. In other words, the cylinder may extend horizontally or substantially horizontally according to the present invention.

In the first and second embodiments, the intake rocker arm 33 has been described as being held in abutment against the intake valve 40 by the center of gravity of the intake rocker arm 33 which is displaced by the weight 67. However, the present invention is not limited to such an arrangement. The intake rocker arm 33 may be turned toward the intake valve 40 side by the weight 67 to position the pusher 70 above the rotational shaft 35, but out of abutting contact with the intake valve 40.

In the first and second embodiments, the intake cam 38, the intake rocker arm 33, and the intake valve 40 have been described by way of example. However, the present invention is also applicable to an exhaust cam, an exhaust rocker arm, and an exhaust valve.

DESCRIPTION OF REFERENCE SYMBOLS

10, 210 Internal combustion engine
12L, 212 Cylinder assembly (cylinder)
23 Valve operating apparatus
33 Intake rocker arm (rocker arm)
35 Rotational shaft
38 Intake cam (cam)
40 Intake valve (valve)
65 Bearing
67 Weight
70 Pusher
W1 Width (width of weight)
W2 Width (width of bearing)

The invention claimed is:

1. A valve operating apparatus for use in an internal combustion engine, comprising:

a cam;

a rocker arm rotatable about a rotational shaft and driven by the cam; and a valve configured to be pushed by a pusher of the rocker arm, wherein the internal combustion engine has a cylinder lying horizontally, wherein the rocker arm has a weight portion adjusting the center of gravity of the rocker arm to position the pusher above the rotational shaft while the cam is held out of abutting contact with the rocker arm, wherein the cam includes an entire periphery that is in a circumferential direction of the rotational shaft and comprises a base-circle portion in a completely round shape and a cam lobe projecting radially outwardly from the base-circle portion, wherein the valve is on a first side of the rotational shaft with respect to an axial direction of the cylinder and the cam is on a second side of the rotational shaft with respect to an axial direction of the cylinder, wherein the weight portion is located on the first side of the rotational shaft, and wherein the weight portion has a weight such that the rocker arm is turned to a position that the rocker arm abuts against the valve when the entire periphery of the cam is out of abutment with the rocker arm.

2. The valve operating apparatus for use in an internal combustion engine according to claim 1, wherein the weight portion extends substantially horizontally.

3. The valve operating apparatus for use in an internal combustion engine according to claim 1, wherein the weight portion is positioned opposite to the cam with respect to the rotational shaft in the axial direction of the cylinder and extends substantially horizontally.

4. The valve operating apparatus for use in an internal combustion engine according to claim 1, wherein a width of the weight portion is smaller than a width of a bearing by which the rocker arm is supported on the rotational shaft.

5. The valve operating apparatus for use in an internal combustion engine according to claim 1, wherein with respect to the axial direction of the cylinder, the rotational shaft is positioned between an axial end of the valve and a camshaft of the cam, the axial end of the valve abutment with the pusher, and wherein the weight portion is positioned opposite to the cam with respect to the rotational shaft in the axial direction of the cylinder.

6. The valve operating apparatus for use in an internal combustion engine according to claim 1, wherein a camshaft of the cam is disposed in such a position that an axis of the camshaft is superposed on an extension of an axis of the valve, and wherein the weight portion is positioned opposite to the cam with respect to the rotational shaft in the axial direction of the cylinder.

* * * * *